United States Patent [19]

Hildebrand et al.

[11] 4,322,699

[45] Mar. 30, 1982

[54] RADIATING CABLE

[75] Inventors: Helmut Hildebrand, Langenhagen; Gerhard Dunker, Burgdorf, both of Fed. Rep. of Germany

[73] Assignee: Kabel-und Metallwerke Gutehoffnungshütte, Hanover, Fed. Rep. of Germany

[21] Appl. No.: 22,227

[22] Filed: Mar. 19, 1979

[30] Foreign Application Priority Data

Mar. 22, 1978 [DE] Fed. Rep. of Germany ..... 2812523

[51] Int. Cl.[3] ..... H01P 3/06

[52] U.S. Cl. ..... 333/237; 343/771

[58] Field of Search ..... 343/770–772; 333/237

[56] References Cited

U.S. PATENT DOCUMENTS

| | | | |
|---|---|---|---|
| 3,100,300 | 8/1963 | Sletten | 343/771 |
| 3,281,591 | 10/1966 | Takeya | 343/771 |
| 3,795,915 | 3/1974 | Yoshida | 343/771 |
| 4,150,383 | 4/1979 | Andersson et al. | 343/771 |

FOREIGN PATENT DOCUMENTS

| | | | |
|---|---|---|---|
| 1044199 | 11/1958 | Fed. Rep. of Germany . | |
| 1690138 | 2/1968 | Fed. Rep. of Germany . | |
| 4412363 | 1/1966 | Japan | 333/237 |
| 1424685 | 2/1976 | United Kingdom | 333/237 |

*Primary Examiner*—Eli Lieberman

*Attorney, Agent, or Firm*—Smyth, Pavitt, Siegemund & Martella

[57] ABSTRACT

A radiating cable is constructed from an inner conductor and a concentric outer conductor being separated from each other by a dielectric spacer; the outer conductor has openings of similar size and configuration but their density varies periodically in axial direction. In one example, the openings are arranged in circumferential rows and axial rows, the number of openings for circumferential row varies periodically in axial direction. In another example, a single axial row has its openings spaced in a periodically variable spacing.

1 Claim, 5 Drawing Figures

RADIATING CABLE

BACKGROUND OF THE INVENTION

The present invention relates to a radiating coaxial high frequency cable which is comprised of an inner conductor, and an outer conductor holding, for example, the inner conductor in concentric relation by means of dielectric spacer means.

Cable of the variety to which the invention pertains are used, for example, in a manner which combines the transmission function for h.f. energy with the radiating (or receiving) function of an antenna. For example, the cable is laid along a particular path such as a railroad track and a mobile receiver picks up signals radiated from this antenna cable. This mode of transmission is used, for example, inside of a tunnel, to avoid interruption of communication with a train passing through. The cable is laid on the ties, next to the track or along the tunnel's wall. The transmission may well occur in the reverse direction, the cable functioning as a receiving antenna, the transmitter being mobile.

In order to provide for the transmission, of radiation out of the cable, the outer conductor is usually of open construction. For example, German printed patent application No. 10 44 199 discloses a coaxial cable whose outer conductor has an axial, longitudinal slot. This cable is of rather simple construction and can be made quite easily. The cable serves as wide band transmitter antenna and is satisfactory if the signal to be received does not have to be very uniform. It was found that the external electrical field set up by the slot varies significantly in strength on account of superpositioning of several cable modes. The amplitude of the signal, when received on and along the outside of the cable, varies strongly accordingly.

German printed application No. 16 90 138 discloses a radiating h.f. cable whose outer conductor is of tubular configuration, and the tube has spaced-apart slots for emitting an electromagnetic field. The slots vary in direction and form and establish a non-continuous zigzag line. This arrangement of slots is to suppress the axial component of the field and enhances the radial component as far as radiating transmission is concerned. Length, width and angle of inclination of these slots are parameters determining the strength of the radiating field, and the spacing of the slots determines the transmission band. Generally speaking, different transmission characteristics require different slot arrangements, patterns, dimensions, etc. This is particularly true on account of the fact that such a cable has a narrow bandwidth as far as its antenna function is concerned. Thus, the purpose of a particular cable is limited and different cables, for different purposes, are to be made differently so that one needs different tooling. Generally then, the making of such a radiating cable is not very economical.

U.S. Pat. No. 3,795,915 describes a radiating cable whose bandwidth has been enlarged by using many slots which differ in length and orientation, there being a periodically repeated pattern. Indeed, this cable can be used for operation over a wider frequency band, but due to the complex slot pattern, it is quite expensive to make.

DESCRIPTION OF THE INVENTION

It is an object of the present invention to provide a new and improved radiating, high frequency coaxial cable, which avoids the drawbacks outlined above, and particularly provides for broad band radiation transmission at a uniform field strength, while it can be made in an economical manner.

It is a specific object of the present invention to improve a coaxial cable which is comprised of an inner conductor, an outer conductor and a dielectric means between the conductors to provide, for example, for the coaxial and concentric relation between them; the outer conductor having an open construction.

In accordance with the preferred embodiment of the present invention, the cable as per the specific object is to be improved by providing the outer conductor with a plurality of openings being of similar size and shape, but being arranged to have a density, i.e. number of openings per unit area, which varies, particularly periodically, in axial direction. One can also say that the density of these similar size openings is to be larger (smaller) in areas from which a larger (smaller) intensity is to be radiated.

Specifically, one will provide the openings, for example, in a pattern consisting of axial and circumferential rows, whereby the number of openings in circumferential rows varies periodically in axial direction. Alternatively, one may use at least one axial row of openings and vary the axial spacing periodically. The openings are all of similar size and shape. A change in the transmission and radiation characteristics as far as manufacturing is concerned, can readily be accomplished by changing the spacing and/or the periodicity of the pattern. The outer conductor is to be prepared by punching holes in a strip before folding the strip around the dielectric spacer. The hole pattern can be varied by control of the timing of the punch or punches.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a transmitter station 1 for transmitting h.f. energy and signals along a particular path. For this purpose, a cable 3 is laid along that path and coupled to the transmitter station 1 by a conventional output coupler 2. The cable is laid, e.g. along a railroad track, on the ties for the track, along the wall of a tunnel or otherwise as needed. The cable is suitably terminated by a conventional termination device 4 which particularly prevents reflections of the energy that arrives at the cable end.

Figure 1:
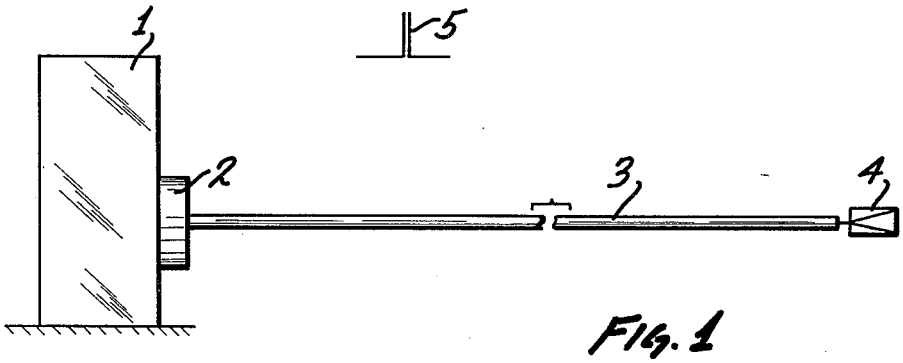
FIG. 1 is a schematic view of a radiating transmission line improved in accordance with the preferred embodiment of the present invention.

Reference numeral 5 denotes a mobile antenna being arranged, for example, on a vehicle that runs on the track along which the cable has been laid. The antenna 5 will be sufficiently closely positioned to and uniformly spaced from the cable 3, to pick up radiated energy. The radiation from the cable 3 is provided by the particular construction of the outer conductor of this coaxial cable in a manner to be described next.

Figure 2:
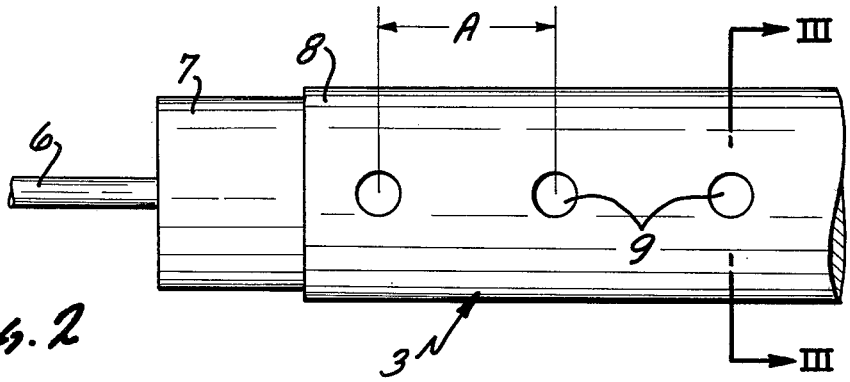
FIG. 2 is a side view, partially cut open of a portion of the cable used in the system of FIG. 1, but being of a more general nature as far as illustration is concerned.
Figure 3:
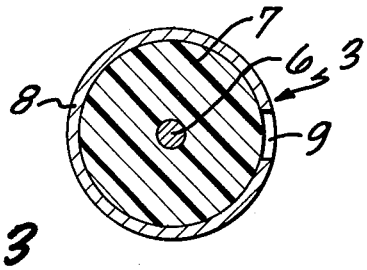
FIG. 3 is a cross-section taken along line III—III in FIG. 2.

FIGS. 2 and 3 are of a more general significance showing a coaxial cable to be comprised of an inner conductor 6, a dielectric spacer 7, made of a solid or a foamed polymer, and an outer conductor 8 in concentric relation to the inner conductor 6.

The outer conductor 8 is provided with openings such as 9 shown to be arranged in an axial spacing pattern, the axial spacing being denoted by the character A. In order to ensure uniform receiving characteristics, spacing A is attuned to the transmission band. For example, for an emission of 400 MHz and a propagation speed in the cable of 66% of the speed of light, one will find that A=50 cm.

The construction as shown thus far provides for a uniform external field strength of the radiated h.f. signal, but the frequency range (bandwidth) is quite narrow. One could enlarge the bandwidth by providing additional openings of smaller diameter in order to establish a periodically variable receiver field strength, but, as was stated above, one will immediately encounter problems in the manufacturing of such a cable.

Figure 4:
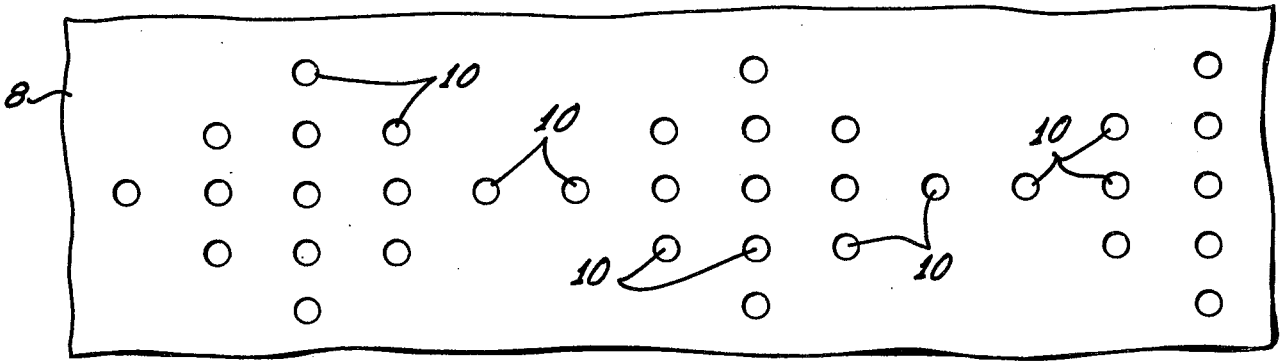
FIGS. 4 and 5 are geometric developments of different outer conductors for the cable of FIGS. 1 to 3.
Figure 5:
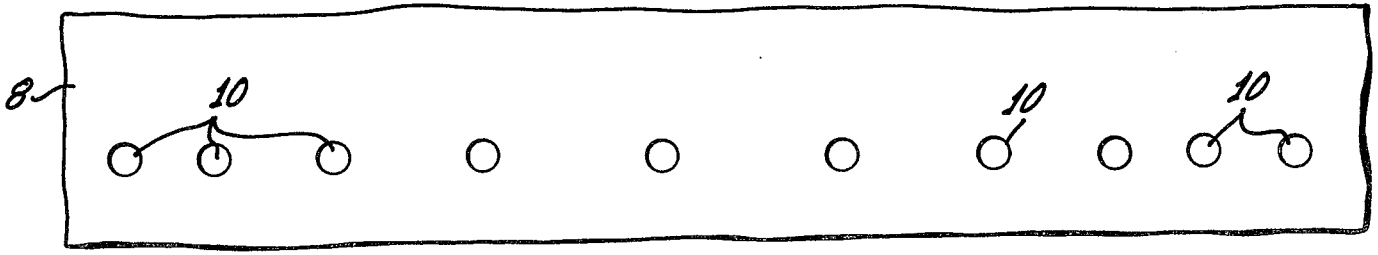

It is, therefore, preferred to modify and/or supplement the pattern of openings in a manner and in ways as shown in FIGS. 4 and 5. Turning first to FIG. 4, one can see a central (axial) row of apertures or openings, quite equivalent to the apertures 9 of FIGS. 2, 3, but supplemented by additional apertures, arranged in circumferentially extending rows. All apertures are identified by numeral 10 in this figure. The apertures or openings are all similarly contoured and dimensioned, but they are provided an an axial circumferential pattern being characterized by a uniform spacing, at least in parts as far as the circumferential arrangement is concerned; also the axial spacing of the circumferential rows is a uniform one, but the number of apertures or openings in the circumferential rows differ. This difference varies periodically along the cable, pursuant to the general rule of providing a periodically variable density in the openings.

It was found that the field strength that can be received at a suitable (uniform) distance from such a cable, varies approximately sinusoidally, as the pattern of openings has an envelope which is a rough approximation of a sine wave. Take the axial direction of wave propagation in the cable, the number of bores (circumferentially) encountered goes up and down and up again between a maximum in the number of openings in the circumferential rows, and a minimum (just one opening) and back to a maximum, etc. This type of cable permits receiving of h.f. energy at an almost uniform signal intensity and strength, and the bandwidth is made larger than in the case of a single axial row of openings.

The outer conductor for the cable and as improved in accordance with this example, can be easily made. The outer conductor is made from a copper strip or any other suitable metal strip and is fed into a punching or stamping tool. This tool has several punches arranged, e.g. in a row transversely to the longitudinal direction of strip feeding. As the strip passes the punches are controlled individually in accordance with the desired pattern. In this particular example, five punches are used and activated in numbers in accordance with the illustrated pattern. The strip is advanced in steps being equal to the axial spacing of the openings or the latter is an integral multiple of the feed step length.

During each punch cycle, the central punch is activated always, but acts alone for two cycles. In a next cycle the two punches closest to that central one are also activated; in the next cycle all five are activated; thereafter only the former three punches are again activated, followed by two cycles in which the central one is activated alone, etc., etc.; the entire pattern is cyclically repeated, the repetition cycle requiring ten punch cycles. Since the axial spacing of the openings in the central row is to be uniform, the punch cycles are repeated at a constant rate for constant strip feeding.

The strip 8 is thereafter formed into a tube around the spacer and dielectric material 7 and, preferably, the abutting or overlapping edges are welded together.

The outer conductor depicted in a development (geometric) in FIG. 5, has just one row of openings but their axial spacing is not a uniform one; the spacing varies periodically. One will need a single punch only but varys the timing of activation. However, one may also use plural axial rows of variable density and spacing for the apertures. The distance between the center of a minimum axial space to the center of the next, following maximum space, is the same as the distance from the latter center to the center of the minimum space thereafter, etc., in periodically varying sequence.

From a practical point of view, the strip may be advanced in steps and the various spacings between apertures is preferably an integral multiple of this fixed, unit step length. Clearly, the punching program will become fairly simple and is expressed in numbers of advancing steps, to be counted and clocked from the strip advance and translated into particular timing signals for the punch activation.

Using fixed length step advance of the strip and axial spacings which are integral multiples of that step length, is generally an advisable mode of operation, to be used also for making an outer conductor as shown in FIG. 4. Making different patterns, and/or spacings in different conductors for different purposes (bandwidth, center frequency, etc.) is now merely a matter of timing and counting unit step advances for the control of the punches.

The examples as shown provide for openings and apertures of circular contour. This is convenient but not essential; instead one could provide polygonal openings. One will just need differently contoured punches.

The invention is not limited to the embodiment described above but all changes and modifications thereof not constituting departures from the spirit and scope of the invention are intended to be included.

We claim:

1. A radiating coaxial cable, being comprised of an inner conductor, an outer conductor concentrically arranged about the inner conductor, and dieletric means between the conductors, the improvement comprising:

openings in the outer conductor, being of uniformly similar shape and size, and arranged at periodically variable density in axial direction in that said openings being arranged in axial rows and in circumferential rows, the axial spacing of the apertures in at least one axial row remaining uniform, the number of apertures in the circumferentially extending rows vary periodically in axial direction so that the intensity of radiation, radially away from the cable, varies correspondingly periodically in axial direction.

* * * * *